US006178716B1

(12) United States Patent
Chen

(10) Patent No.: US 6,178,716 B1
(45) Date of Patent: Jan. 30, 2001

(54) REINFORCED-CONCRETE FLOOR SLAB THICKNESS INDICATOR/REINFORCEMENT ROD SPACER COMBINATION

(76) Inventor: Hsin-hsiung Chen, No. 285, Mintsu 1st Rd., Kaohsiung (TW)

( * ) Notice: Under 35 U.S.C. 154(b), the term of this patent shall be extended for 0 days.

(21) Appl. No.: 08/593,490

(22) Filed: Jan. 30, 1996

(51) Int. Cl.[7] ..... E04C 5/16

(52) U.S. Cl. ..... 52/678; 52/365; 52/684; 404/135; 404/136

(58) Field of Search ..... 33/833; 52/365, 52/677, 678, 684, 685, 686; 404/134, 135, 136

(56) References Cited

U.S. PATENT DOCUMENTS

| | | | | |
|---|---|---|---|---|
| 2,373,284 | * | 4/1945 | Autrey | 52/678 |
| 3,579,938 | * | 5/1971 | Hanson | 52/365 |
| 3,645,002 | * | 2/1972 | Hefti | 33/833 X |
| 4,835,933 | * | 6/1989 | Yung | 52/685 |

FOREIGN PATENT DOCUMENTS

| | | | | |
|---|---|---|---|---|
| 1276317 | * | 8/1968 | (DE) | 52/684 |
| 2549870 | * | 2/1985 | (FR) | 404/135 |
| WO90/01600 | * | 2/1990 | (WO) | 52/685 |

* cited by examiner

*Primary Examiner*—Carl D. Friedman
*Assistant Examiner*—Kevin D. Wilkens
(74) *Attorney, Agent, or Firm*—Bacon & Thomas

(57) ABSTRACT

A reinforced-concrete floor slab thickness indicator/reinforcement rod spacer combination consists of a base, a spacer and an indicator erected from the base, and a bracket integrally and laterally extended from the spacer. The indicator is releasably attached to the bracket by a U-shaped clamping member cooperating with a cam member. The spacer consisted of a seat fixedly mounted on the base, a medial portion threadedly connected with the seat and a supporting portion slideably mounted on the medial portion.

9 Claims, 6 Drawing Sheets

REINFORCED-CONCRETE FLOOR SLAB THICKNESS INDICATOR/REINFORCEMENT ROD SPACER COMBINATION

FIELD OF THE INVENTION

The present invention is related to a fitting used in a building site. Particularly, the present invention is related to a fitting which combines both the functions to space the reinforcement rod from a shuttering frame for forming a reinforced-concrete floor slab of a building a predetermined distance, and to indicate the thickness that the floor slab should obtain after concrete slurry is poured onto the shuttering frame and hardened thereon.

BACKGROUND OF THE INVENTION

Conventionally, when constructing a reinforced-concrete building, spacers in the form of cement blocks are used to space reinforcement rods from the shuttering frame for forming a floor slab of the building a distance thereby to enable the floor slab to have an optimal strength.

Also, indicators are used for workers to easily perceive what is the thickness that the floor slab is intended to obtain so that they can decide when to stop the pouring of the concrete slurry into the shuttering frame.

Since the conventional spacers and indicators are individual from each other, to lay them on the shuttering frame is very laborious. Furthermore, since the height of the conventional indicators cannot be easily adjusted, the conventional indicators cannot be easily adapted to different building conditions which respectively require a different thickness for the floor slab.

In view of the disadvantages of the prior art, the present inventor has invented a reinforced-concrete floor slab thickness indicator/reinforcement rod spacer combination 80 (as shown in FIG. 8) which combines the indicator and spacer into a single unit, wherein the combination 80 forms a prior art of the present invention.

Referring to FIG. 8, the combination 80 consists of an indicator 81 and a spacer 82 fixedly mounted on a base 89. The indicator 81 comprises an indicating portion 816, a threaded post 812 fixedly mounted on the base 89 and a first spring 814 connecting the indicating portion 816 and the threaded post 812 together. The first spring 814 can have a movement along the post 812 by rotating the first spring 814 about the post 812 so that the level of the indicating portion 816 may be adjusted to meet different building conditions.

The spacer 82 comprises a rod 83 fixedly connected to the base 89, a medial portion 85 slideably mounted on the rod 83, a second spring 84 has a first end seated on the base 89 and a second end supporting the medial portion 85, and a supporting portion 86 defining a reinforcement rod receiving recess 87, the supporting portion 86 being threadedly engaged with the medial portion 85. By rotating the supporting portion 86 about the medial portion 85, the level of the supporting portion 86 can be adjusted.

Although the above combination 80 which has a dual function to indicate the floor slab thickness and space the reinforcement rod from the shuttering frame a distance, is proved to be able to function well, it still has some disadvantages which need to be improved.

Among these disadvantages, the first is that to rotate the first spring 814 about the threaded post 812 to move the first spring 814 along the threaded post 812 is not convenient, and further causes the level of the indicating portion 816 to be not easily and quickly adjusted.

Furthermore, since the supporting portion 86 together with the medial portion 85 is only slideably supported on the relatively slim rod 83 by the second spring 84, the rigidity for supporting the medial and supporting portions 85, 86 is relatively poor, which results in that the reinforcement rod put on the supporting portion may not be able to be stabilized at its intended location. This situation becomes aggravated particularly when the flow of the concrete slurry poured onto the shuttering frame on which the combination 80 is laid has a violent current. If this situation happens, the reinforcement rod supported by the spacer 82 cannot be retained in its intended position, and, thus, the reinforced-concrete floor slab, which includes the reinforcement rod supported by the spacer 82 will not be able to obtain an optimal strength.

The present invention is disclosed to obviate/mitigate the above mentioned disadvantages of the conventional wooden shuttering frame.

SUMMARY OF THE INVENTION

It is an objective of the present invention to provide a reinforced-concrete floor slab thickness indicator/reinforcement rod spacer combination wherein the level of the indicator can be easily adjusted.

A further objective of the present invention is to provide a reinforced-concrete floor slab thickness indicator/reinforcement rod spacer combination wherein the reinforcement rod can be stably supported by the spacer.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
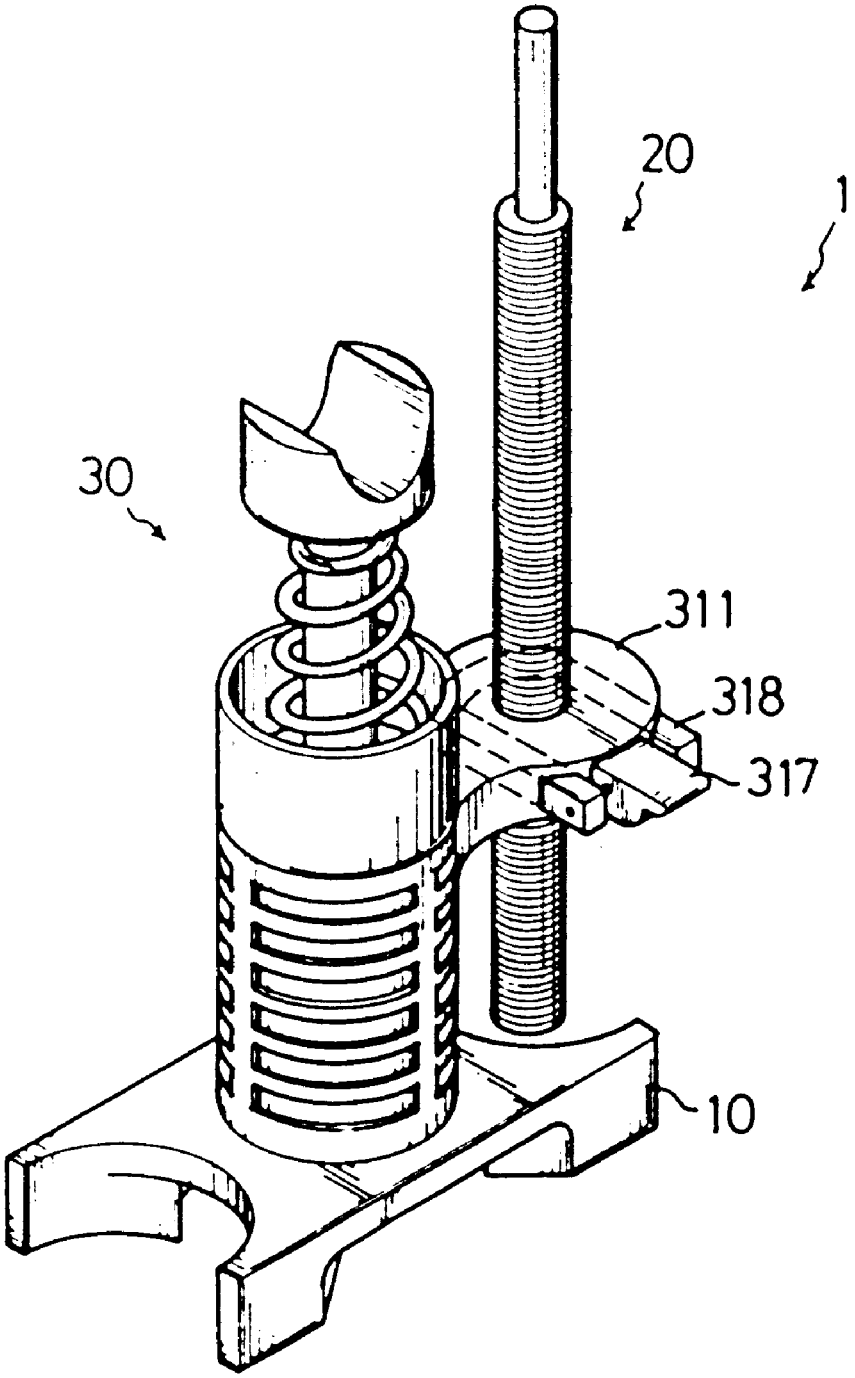
FIG. 1 is a front-left-top perspective view of a reinforced-concrete floor slab thickness indicator/reinforcement rod spacer combination in accordance with the present invention.

Referring to FIG. 1, a reinforced-concrete floor slab thickness indicator/reinforcement rod spacer combination in accordance with the present invention is shown which is generally indicated by reference number 1. The combination 1 mainly consists of a base 10, a spacer 30 erected from and supported by the base 10, and an indicator 20 supported by a bracket 311 which is integrally and laterally extended from the spacer 30.

Figure 2:
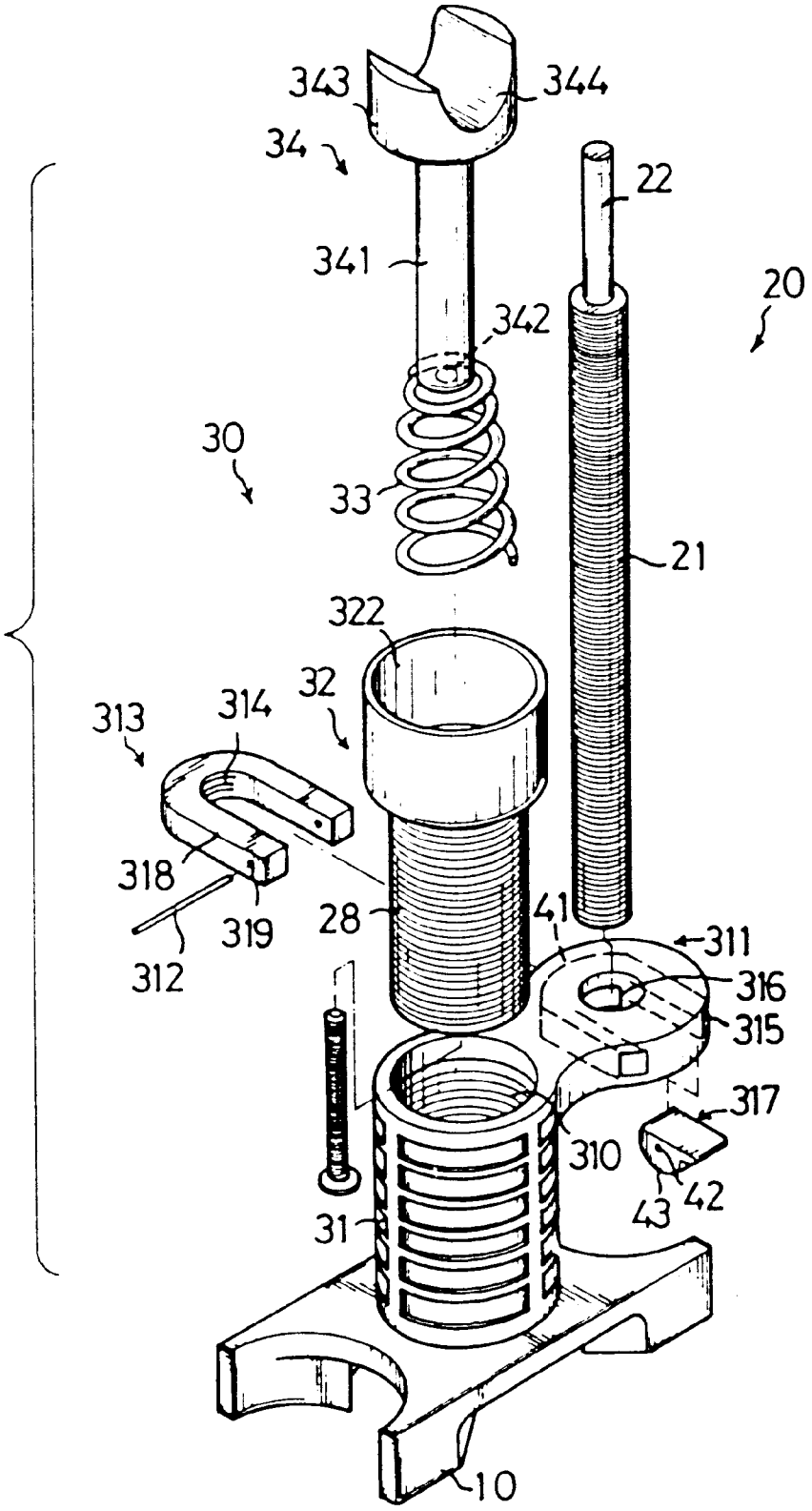
FIG. 2 is an exploded perspective view showing the components constituting the present invention.
Figure 3:
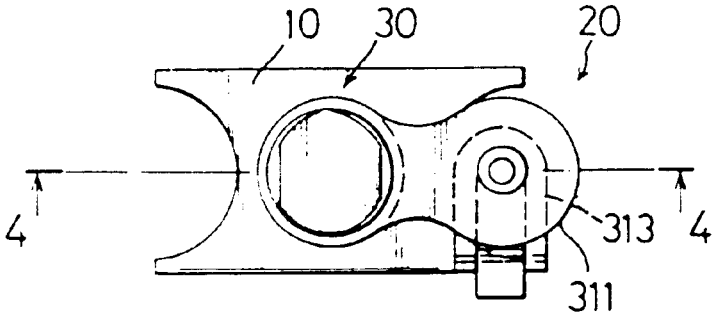
FIG. 3 is a top view of FIG. 1.
Figure 4:
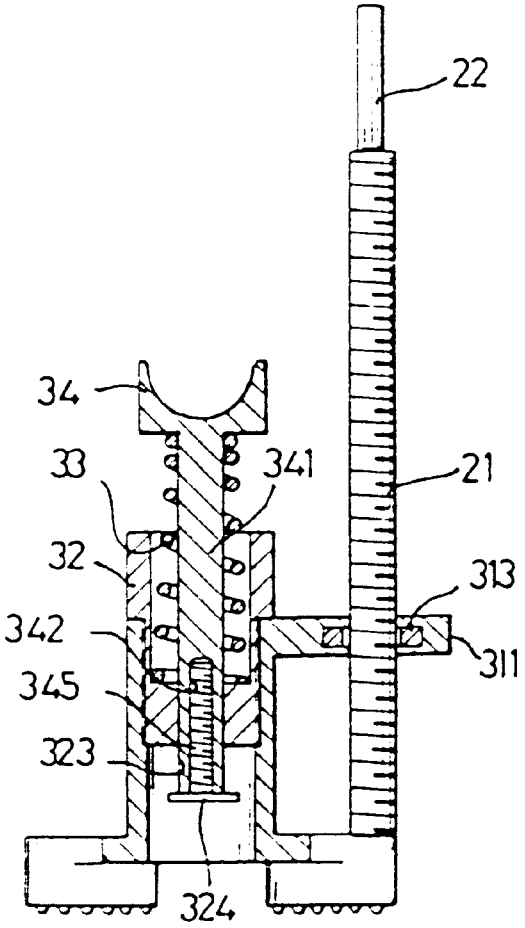
FIG. 4 is cross-sectional view taken along line 4—4 of FIG. 3.
Figure 6:
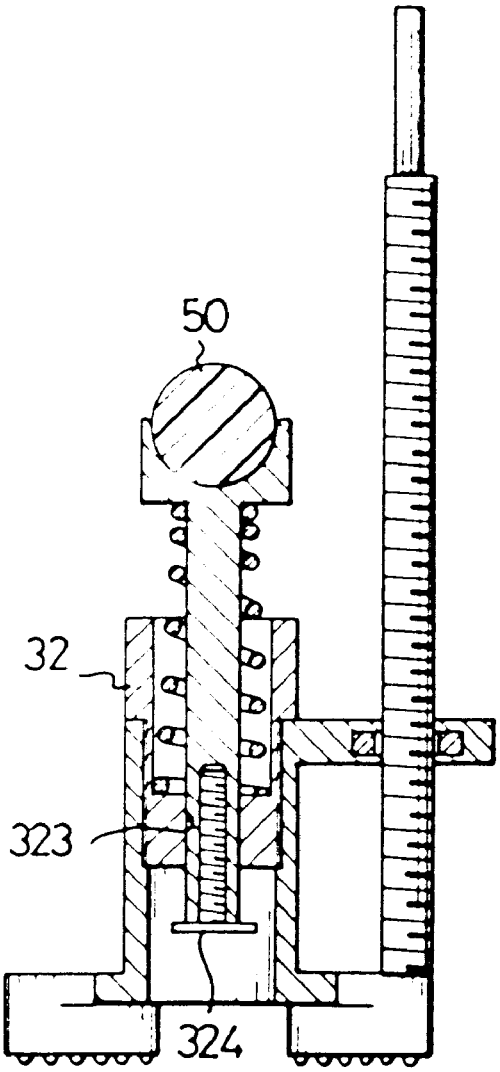
FIG. 6 is view similar to FIG. 4 but showing that a reinforcement rod is put on the spacer of the present invention.

Also referring to FIG. 2, the spacer 30 consists of a seat portion 31, a medial portion 32, a spring 33 and a reinforcement rod supporting portion 34. The seat portion 31 is erected from and fixedly attached to the base 10, and has a relatively large size (i.e., having a diameter substantially the same as a width of the base 10) thereby to provide sufficient rigidity for supporting the medial and supporting portions 32, 34. The seat portion 31 is cylindrical and defines an inner threaded periphery 310. The medial portion 32 has an upper part defining a concavity 322 wherein the spring 33 is received. A lower part of the medial portion 32 defines an outer threaded portion 28 used to engage with the inner threaded periphery 310 of the seat portion 31. The spring 33 is received in the concavity 322 and is used to exert a spring force on the supporting portion 34. The supporting portion 34 has a head 343 defining a recess 344 for a reinforcement rod to stably rest therein, and a downwardly extending rod 341 which is used to fixedly mount the supporting portion 34 on the medial portion 32. A threaded periphery defines a longitudinal hole 342 in the rod 341 near a free end thereof. Particularly referring to FIG. 4, the rod 341 is extended into the medial portion 32, extending through a mating hole 323 defined in the lower part of the medial portion 32, and connected with a screw 345 by threadedly engaging a threaded portion of the screw 345 in the periphery defining the hole 342. Since the screw 345 has a head 324 which is so dimensioned that an edge thereof will be blocked by a bottom face of the medial portion 32 during an upward movement of the supporting portion 34 due to the spring force of the spring 33, the upper-most position of the supporting portion 34 can be limited.

Figure 5:
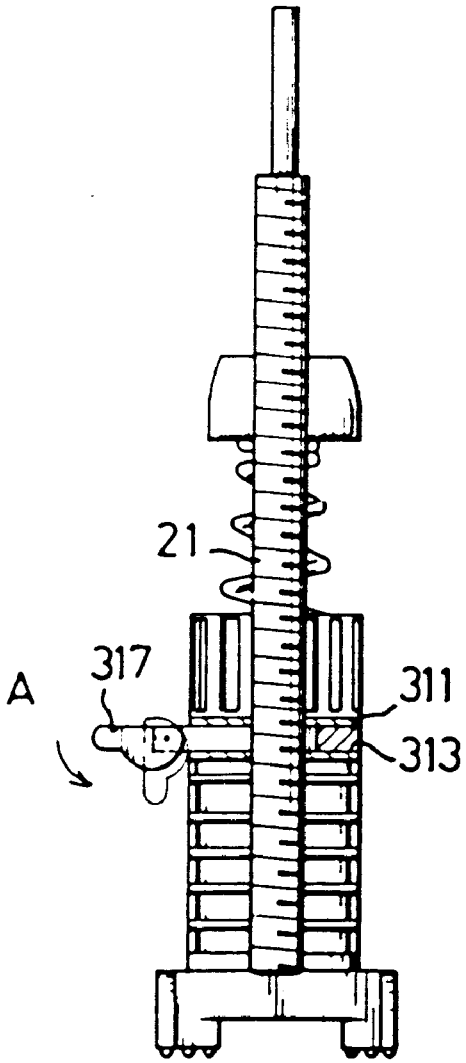
FIG. 5 is right side view of FIG. 1, with a part cut away to show that a clamping member is operated to engage or disengage with an indicator.

Returning to FIG. 2, the bracket 311 is configured to generally have a circular configuration. A hole 316 is defined in and vertically extends through the bracket 311. Two parallel slots 315 are defined in and horizontally extend through the bracket 311. The slots 315 extend through a periphery of the bracket 311 and are located on either side of the hole 316. A U-shaped clamping member 313 defining a clamping portion 314 is fitted onto the bracket 311 by extending two straight portions 318 thereof respectively into the slots 315 until each end of each straight portion 318 protrudes from the periphery of the bracket 311 a distance (better seen in FIG. 1). An end of each straight portion 318 has defined therein a pin hole 319. The clamping portion 314 of the clamping member 313 is formed by a plurality of ridges defined on an inner surface of a curved portion of the clamping member 313. A curved cutout 41 is defined on a portion of the periphery of the bracket 311. Said cutout 41 is defined by two sides respectively extending into the slots 315 and an edge extending into the hole 316 thereby to cooperate with the slots 315 to define a space which has a shape substantially the same as that of the U-shaped clamping member 313. A cam member 317 is pivotably mounted between the two ends of the two straight portions 318 of the clamping member 313 (better seen in FIG. 1) by extending a pin 312 through the pin holes 319 of the clamping member 313 and a pin hole 42 defined in the cam member 317. The cam member 317 has a cam surface 43 which is in continuous contact with the periphery of the bracket 311. The cam surface 43 is so configured that when the cam member 317 is operated to be located at a horizontal orientation as shown by the solid lines in FIG. 5, the clamping member 317 is set to an unlocking position wherein the clamping portion 314 is not extended into the holes 316. Alternatively, when the cam member 317 is pivoted in a direction as shown by the arrow A of FIG. 5 to reach a vertical orientation as indicated by the phantom lines in FIG. 5, due to a camming action of the cam surface 43 on the periphery of the bracket 311, the cam member 317 will exert a pulling force on the clamping member 313 via the pin 312 to pull the clamping member 313 toward the bracket 311 so that the clamping member 313 can be shifted from the unlocking position to reach a locking position wherein the clamping portion 314 is extended into the hole 316.

Returning to FIG. 2, the indicator 20 is composed of a body portion 21 which is formed by a threaded post and an indicating portion 22 which is formed by a plastic rod. The body portion 21 is extended through the hole 316 wherein the body portion 21 has an outer diameter slightly smaller that the inner diameter of the hole 316 so that body portion 21 can freely move through the bracket 311 when the clamping member 313 is located at its unlocking position. When the clamping member 313 is shifted to its locking position by the action of the cam member 317, the ridges on the clamping portion 314 of the clamping member 313 will extend into the hole 316 to engage with a periphery of the body portion 21 and exert a clamping force thereon so that indicator 20 can be locked in position. Since it is very convenient to operate the cam member 317 to shift the clamping member 313 between the unlocking and locking position, and when in the unlocking position, the indicator 20 can be freely moved through the bracket 311 and when in the locking position, the clamping member 313 can effectively lock the indicator 20 in position, the level of the indicator 20 can be very quickly and easily adjusted.

Figure 7:
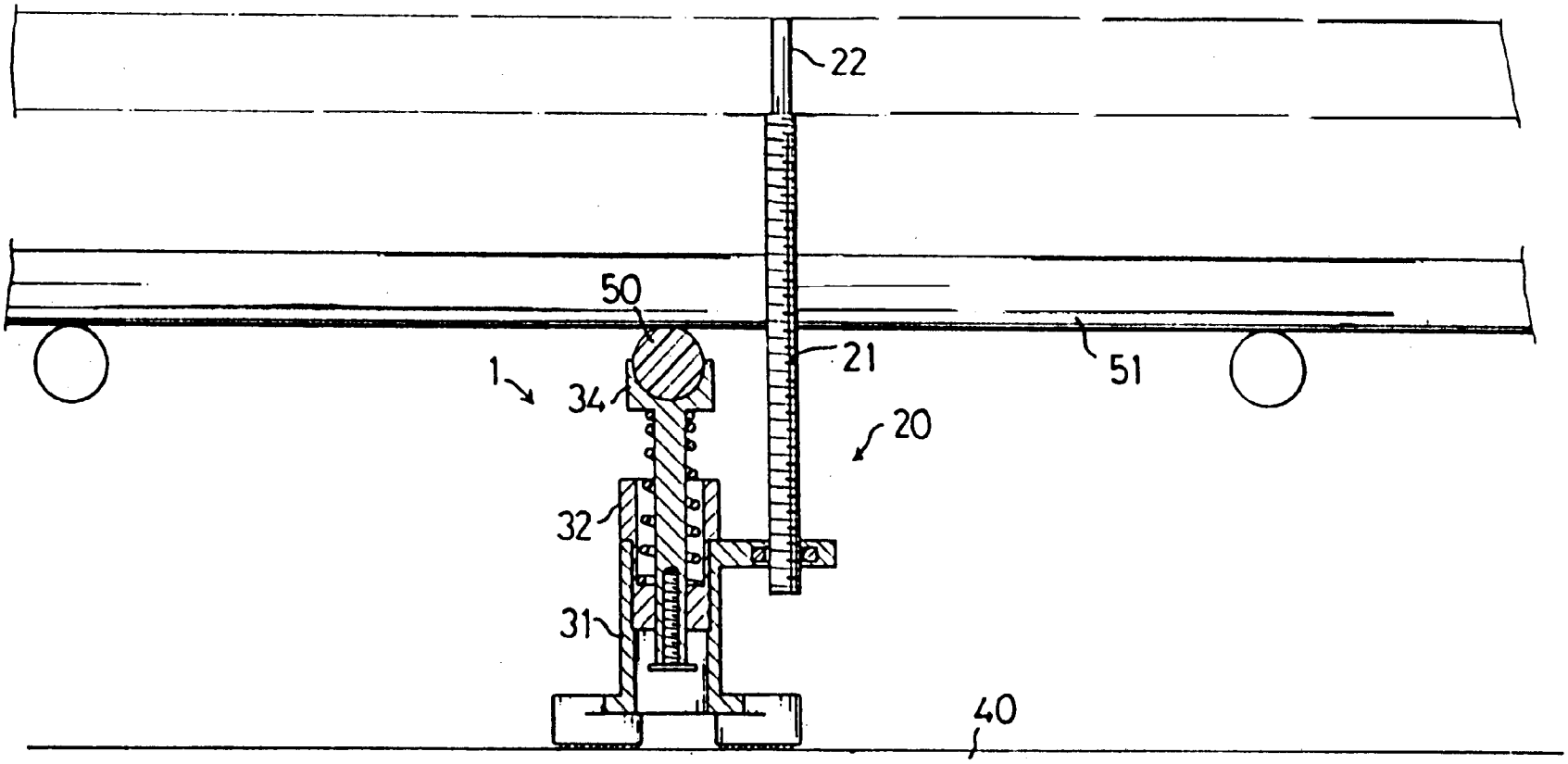
FIG. 7 is a diagrammatic view showing the present invention used in a construction site.
Figure 8:
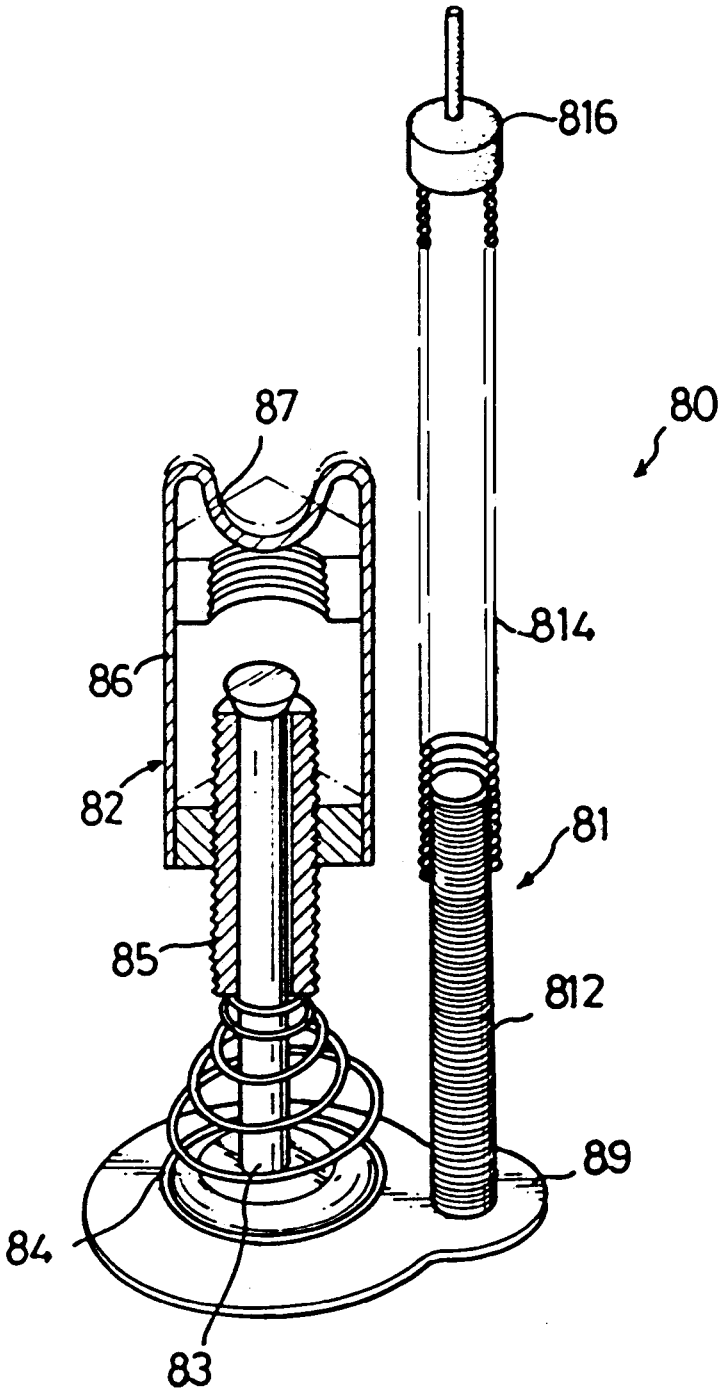
FIG. 8 PRIOR ART
FIG. 8 is a perspective view, partly in cross-section, showing a prior art reinforced-concrete floor slab thickness indicator/reinforcement rod spacer combination.

Finally refer to FIG. 7, which shows the situation that the present combination 1 is used in a construction site to space the reinforcement rods from the shuttering frame and to indicate the thicknesses that concrete slurry and cement-sand plaster should be respectively applied to the shuttering frame. Firstly, the combination 1 is put on a shuttering frame 40 for forming a floor slab. Then, the level of the indicator 20 is adjusted to a required level, wherein the phantom lines extend through a top edge of the body portion 21 of the indicator 20 indicate the level that the concerted slurry is required to be poured onto the shuttering frame 40 and the phantom lines extend through a top of the indicating portion 22 indicate the level that the cement-sand plaster will be added to the hardened concrete slurry for finishing the floor slab. Since the indicating portion 22 is formed by a plastic rod, its level can be easily adjusted by applying a cutting action thereon thereby to meet different construction conditions. Then, a reinforcement rod 50 is put on the supporting portion 34 wherein if the level of the reinforcement rod 50 does not meet the required level, the worker may remove the reinforcement rod 50 from the supporting portion 34 and rotate the medial portion 32 about the seat portion 31 to adjust the level of the supporting portion 34 and return the reinforcement rod 50 to the supporting portion 34. When all of the reinforcement rods 50 are suitably set up, further reinforcement rods 51 are placed on the rods 50 to complete the laying of the reinforcement rods on the shuttering frame 40.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A reinforcement-concrete floor slab thickness indicator/reinforcement rod space combination, comprising:

a base, a reinforcement rod spacer fixedly mounted on the base, comprising:

a cylindrical seat portion fixedly mounted on the base and having a diameter dimensioned substantially the same as a width of the base, a medial portion threadedly engaging with the seat portion and defining a concavity, a reinforcement rod supporting portion slideably mounted on the medial portion and a spring mounted between the medial portion and the supporting portion to continuously exert a cushioning force on the supporting portion; and a floor slab thickness indicator sub-assembly, comprising:

mounting means fixedly attached to a portion of the spacer;

clamping means slideably mounted on the mounting means and movable between a locking and an unlocking position;

controlling means connected with the clamping means and movable between a first and a second position whereby when the controlling means is moved to the first position, the clamping means is moved to the unlocking position, and when controlling means is moved to the second position, the clamping means is moved to the locking position; and an indicator extending through the mounting means whereby when the clamping means is moved to the locking position, the clamping means fixedly engages with the indicator and locks the latter in position, and, when the clamping means is moved to the unlocking position, the fixed engagement between the indicator and the clamping means is released.

2. The combination in accordance with claim 1 wherein the indicator comprises a body portion formed by a threaded post and an indicating portion formed by a plastic rod.

3. The combination in accordance with claim 1, wherein the supporting portion has a head defining a recess adapted to receive a reinforcement rod and a rod slideably extending into the medial portion, said rod defining a threaded portion engaging with a screw, said screw having a head cooperating with the medial portion to limit the sliding movement of the supporting portion in relative to the medial portion.

4. The combination in accordance with claim 3 wherein the spring is mounted around the rod and located between the medial portion defining the concavity and the head of the supporting portion to exert the cushioning force on the head.

5. The combination according to claim 1, wherein the mounting means is a bracket fixedly attached to the seat portion of the spacer and has a substantially circular configuration defining a hole for the indicating portion to extend therethrough.

6. The combination according to claim 5, wherein the bracket defines two parallel slots located beside the hole and a curved cutout defined in a periphery of the bracket, said curved cutout being defined by two sides respectively extending into the slots and an edge extending into the hole, the clamping means is a U-shaped clamping member having two straight portions extending into the slots, a curved portion fitting into the curved cutout and a clamping portion defined on an inner side of the curved portion whereby when the clamping means is positioned in the locking position, the clamping portion is extended into the hole, and, when the clamping means is positioned in the unlocking position, the clamping portion is positioned outside of the hole.

7. The combination in accordance with claim 6, wherein the clamping portion of the clamping member is formed by a plurality of ridges.

8. The combination in accordance with claim 6, wherein each of the straight portions of the clamping member is protruded from the periphery of the bracket a distance, and, wherein, said controlling means is a cam member defining a cam surface in continuous contact with the periphery of the bracket, said cam member being located between the two straight portions and pivotably connected thereto by means of a connecting member.

9. The combination in accordance with claim 8, wherein the connecting member is a pin extending through the straight portions of the clamping member and the cam member.

* * * * *